US006767011B2

(12) United States Patent
Kavanagh

(10) Patent No.: US 6,767,011 B2
(45) Date of Patent: Jul. 27, 2004

(54) METHOD FOR THE PRODUCTION AND CONTROL OF MERGING CONTINUOUS WEBS WITH VARIABLE DATA THEREON

(76) Inventor: Conor Kavanagh, Rathmore, Adelaide Road, Glenageary, Dublin (IE)

( * ) Notice: Subject to any disclaimer, the term of this patent is extended or adjusted under 35 U.S.C. 154(b) by 0 days.

(21) Appl. No.: 10/181,606

(22) PCT Filed: Jan. 19, 2001

(86) PCT No.: PCT/IE01/00010

§ 371 (c)(1),
(2), (4) Date: Sep. 7, 2002

(87) PCT Pub. No.: WO01/53182

PCT Pub. Date: Jul. 26, 2001

(65) Prior Publication Data

US 2003/0053132 A1 Mar. 20, 2003

(30) Foreign Application Priority Data

Jan. 20, 2000 (EP) ..... 00200224

(51) Int. Cl.[7] ..... B42B 2/00

(52) U.S. Cl. ..... 270/52.02; 270/1.01; 270/1.02; 101/485; 101/228

(58) Field of Search ..... 101/483, 485, 101/224, 225, 226, 227, 228, 232; 270/52.02, 51.1, 52.12, 1.01, 1.02, 52.07

(56) References Cited

U.S. PATENT DOCUMENTS

| | | | | |
|---|---|---|---|---|
| 4,384,522 A | | 5/1983 | Ehlers et al. | |
| 5,136,316 A | * | 8/1992 | Punater et al. | 347/154 |
| 5,279,696 A | * | 1/1994 | Zangenfeind et al. | 156/354 |
| 5,287,976 A | * | 2/1994 | Mayer et al. | 209/547 |
| 5,608,639 A | | 3/1997 | Twardowski et al. | |
| 5,707,055 A | * | 1/1998 | DeJoseph et al. | 270/52.02 |
| 5,915,089 A | | 6/1999 | Stevens et al. | |
| 6,098,063 A | * | 8/2000 | Xie et al. | 706/60 |

FOREIGN PATENT DOCUMENTS

| | | |
|---|---|---|
| EP | 0 096 564 | 12/1983 |

* cited by examiner

*Primary Examiner*—Eugene H. Eickholt
(74) *Attorney, Agent, or Firm*—Wallenstein Wagner & Rockey, Ltd.

(57) ABSTRACT

A method for the production and control of merging continuous webs with variable data therein is described. The method provides for the printing of control codes preceding and antedating live variable data on the web. These control codes are used to match related webs so as to facilitate the matching of related webs during collation.

12 Claims, 4 Drawing Sheets

METHOD FOR THE PRODUCTION AND CONTROL OF MERGING CONTINUOUS WEBS WITH VARIABLE DATA THEREON

This Application is a U.S. National filing under §371 of International Application No. PCT/IE01/00010, filed Jan. 19, 2001, claiming priority from EP Appln. No. 00200224.4, filed Jan. 20, 2000, now pending (which is hereby incorporated by reference).

TECHNICAL FIELD

This invention relates to the merging and collating of multiple continuous webs or plies of stationery. In particular this invention relates to a method of collating different plies with variable data or images printed thereon so as to form a multiple-ply printed product. Although specifically described with reference to a personalised or individually addressed mailer, the term multiple-ply printed product is intended to include multiple ply product such as but not limited to raffle ticket books, computer manuals printed in variable data applications, the production of books, mail packages and direct mail pieces

BACKGROUND ART

Within the printing industry it is well known to collate webs of paper with different material printed thereon to form a finished complete product. Such collation includes the production of business form, books, magazines or newspapers. While accurate collation is necessary in order to ensure that the pages are in the correct sequence, the matter which is printed on each web is non-variable so that the process is much easier. For example, if there is a mistake or misalignment, in overlaying a web containing pages 1 to 8 over the web containing pages 9 to 16, the first web can simply be advanced until page 1 is reached again, and collation can proceed. The matter printed on each page 1 is identical However, such realignment would not be possible when collating webs with variable data printed thereon, because each set of pages to be collated must contain variable data which is related in some way, e.g. page 1 might be a sheet or separable envelope with an individual's address which must be correctly collated with webs containing sheets to be separated which also include pre-printed data relating to the same individual.

Another application for this process would be in collating bank statements printed on separate pages, where there is a second and third continuation page, which must be collated with the top page showing the customer's name and address. Under a present process, the pages may be printed in sequence by the computer on continuous stationery, with a bar-code or other identifier printed at the top. In the collating machine, which separates the pages, the run will actually stop when the bar-code indicates that the next page will be a continuation page or pages. These are collated and then the run continues. Most of the statements might be single page statements. This might apply more so to credit card statements.

Another application would be the collation by Life Insurance and Pension companies of annual policy statements for individuals who have more than one policy with the particular company. At present, separate statements are sent to each individual policy holder for each individual policy resulting in multiple mailings to the same person from the same company. There is a need for supplying a single statement of the different policies with summary information on one sheet, with separate sheets on the current value on maturity, or annual bonuses added, for each individual policy, to be collated and sent to the individual policy holder in one mailing.

Another product is the free insert mailer, as for example described in my international patent application WO-A-9321022. In general, removal of a tear-off stub portion along one side of the mailer allows free withdrawal of the inner ply or plies which are not otherwise attached to the assembly. A basic free insert mailer may comprise front and back outer plies which comprise the envelope, and inner plies comprising, for example, business forms. The inner plies may, for example, be die cut or chipped on two sides so that glue lines running transverse of the web to join the outer plies do not attach the inner plies, which are normally glued longitudinally along a fourth side to attach to the stub portion.

It will be appreciated that the multiple ply assembly is constructed from a plurality of webs which are normally pre-printed and subjected to successive and various transverse and longitudinal chipping, gluing, slitting and perforating steps during collation. As described in U.S. Pat. No. 3,339,827, variable information may be applied to the inner plies by a suitable imprinting apparatus which may be transferred through carbonised paper, either formed as part of the under side of one of the envelope plies or as a separate sheet or from the reaction of an impression made on the two adjacent sheets. The envelope assembly is assembled on-line; printed, collated, adhered, cross perforated and folded on a collator, and then taken off-line where the envelopes are addressed.

Specifically in the production of personalised mailers a major problem exists in the efficient and accurate collation of a multi-piece mailer. Each ply must be correctly aligned, with a related ply from another web of paper, at different stages. This problem is not too difficult if there are a sufficient number of pages for the quantity required to be printed on a single reel. At the start of production the operator manually aligns each web, wherein each ply that is going to form the mailer is positioned at a specific place on a collating machine such that when the mailer is formed all related plies are correctly superimposed upon each other and positioned within the mailer. The operation is much more difficult where there is a requirement for a number of reels, thus involving the joining of a fresh reel to the end of a finished reel. Furthermore, if each reel has variable data, such as names and addresses, printed on it, with the data on one reel related to the data on the other reels; as is the case with a multi-ply personalised mailer, the requirement for accurate, exact and efficient collating is imperative and which up to now has been difficult to guarantee.

As indicated above this accurate collation of different webs is also applicable to different printing fields such as for example utility bills, mailshots etc. Although varying solutions have been suggested for this collation, problems exist with the starting and stopping of the collating machine with the drying of glue and inefficient adhesion of related plies.

There is an obvious requirement for a method and apparatus for the efficient collation of multiple webs of related stationery so as to form a complete product. The accurate and exact collation need is specifically relevant to any personalised or variable data product. There is especially a need for the in-line personalisation of mailers; a method that provides for the placing of variable data, such as names and addresses, on individual webs, and the collation of these related webs in a accurate and exact manner so as to create a multi-ply product that is personalised on two or more plies.

One way to achieve this is to utilise multiple imaging systems in-line at the collating machine, the personalisation is however limited to the number of imaging heads at the collating machine and can be very expensive for multiple personalised pages.

One example of this use of multiple imaging heads is U.S. Pat. No. 5,608,639, which addresses the problem of forming a multiple part printed product with variable data on one or more parts by using an in-line camera within the collating procedure to verify that the collated plies are correct. It also describes the use of imaging systems within the collating procedure to apply the variable data. This in-line imaging system requires an independent imager for each web that is being applied with variable data.

U.S. Pat. No. 5,915,089 provides an improved system to that of U.S. Pat. No. 5,608,639 in that a supplemental data processing system is provided to existing systems for matching and verifying that the collated plies are combined accurately. This system allows for the performance of additional steps such as the triggering of labelling and batching external to the matching and verification system.

Similarly to that described above, U.S. Pat. No. 5,707,055 addresses the problems associated with collation of multiplies by incorporating a verification system into the collation system. This verification system utilises an imaging camera disposed into the collating machine so as to monitor the plies being collated and ensure that accurate collation is being achieved.

Although the above disclosures provide systems and methods for the production of multi-ply printed products they do so by incorporation of verification systems into the collating procedure, so as to confirm that a collated product only contains the desired component plies. They do this in a combination of imaging the variable data onto the individual plies during the collation procedure and then through a utilisation of verification techniques to ensure that accurate collation is maintained. The use of these in-line imaging and verification system requires specific hardware to achieve the desired effect, and in the case of the in-line imaging a unique imaging device associated with each ply of paper to which variable data is to be applied. This is a costly investment in hardware and maintenance for the devices required.

There is therefore a requirement for a method that enables an efficient collation of multiple plies with variable data printed thereon, without requiring the use of multiple imaging heads or verification systems.

SUMMARY OF THE INVENTION

The invention provides a method for the production and collation of multiple plies to form a stationery product, wherein at least two components plies which form part of the multiple ply product have corresponding variable data printed thereon, comprising the steps of:

a) printing variable data on said component plies, b) printing a sequential control code on the lead in portion preceding the variable data printed on said component plies, c) advancing the component plies into register with each other using the sequence of control codes to match component plies having corresponding interrelated variable data, d) collating all the multiple plies so as to form a multi-ply product, which has corresponding plies of pre-printed variable data, and wherein the printing of the variable data and control codes is effected prior to the collation of the multiple plies.

The component plies are printed on individual reels which are then brought to unwind stations at the collating machine and the method may additionally comprise the additional set-up step of positioning reels containing each respective ply at pre-determined unwind stations.

The printing of the variable data and control codes being effected prior to the positioning of the reels at the unwind stations.

The method preferably comprises the further step of printing a sequential control code on the lead-out portion anteceding the variable data, said lead-out control code portion adapted to facilitate the joining of additional reels of component plies so as to form a multiple ply product.

The control codes are preferably a sequence of pre-determined numbers, the length of which is related to the longest distance travelled by any one ply from the unwind station to the alignment location.

The component plies are preferably printed with the variable data in either an in-line or by an off-line process onto reels of paper, and this printing takes place prior to the collation of the reels, using a single imaging station to print all the variable data.

The control code may preferably be a sequence of pre-determined numbers printed before and after the variable data on the printed reel.

The invention also provides a collation method for the collating of multiple reels of webs of paper at a collator so as to form multi-ply printed products comprising the steps of:

a) assembling component reels for the production of the printed products at respective mounting locations of the collator, each reel having a web of paper that will form component plies of the finished multi-ply printed products, b) matching, at an alignment location, lead-in control codes printed on the web of a first reel to corresponding control codes printed on the webs of the other component reels, so that individual plies with related live data in the formed multi-ply printed product are overlaying, c) running the collator until all multi-ply printed products with control codes printed thereon are complete, d) discarding the multi-ply printed products with the control codes printed thereon, and e) completing the collating of the related webs so as to form multi-ply printed products with live data, and wherein printing of the control codes on each web is effected prior to the assembly of the reels at the collator.

Desirably, at least two webs of live data have related variable data printed thereon, and the printing of the variable data is also effected prior to the mounting of the reels at the collator.

The discarding of the collated multi-ply products with the control codes printed thereon may be effected prior or after the completion of the collating of the products with no control codes thereon.

Where the number of multi-ply printed products with live data required is more than can be assembled using a single web from each component reel, the method of the present invention provides for joining of a second web from a new reel to the existing single web of the old reel. The joining is facilitated by the printing of lead-out control codes after the live data on the first web, such that once a web from one of the component reels has lead-out control codes exposed that the collator system is stopped, the reel is taken from the collator and a second reel with lead-in control codes is positioned at its mounting location, the lead-in codes of the second reel are matched with the lead-out codes of the first reel and the collator continued until all multi-ply printed products with control codes exposed are complete and the collator is then continued so as to collate webs with live data thereon.

With the method of the present invention there is no requirement for continuous monitoring of the collating of the webs during the production of the multi-ply printed product with live data, so as to verify that accurate collation is effected. Once the products with the control codes are complete, there is no further need to monitor the collating process, until the end of a print run where there may be a requirement to examine for lead out codes so as to allow for the joining of a new reel.

The number of control codes printed on lead-in and lead-out portions of the webs of the component reels is related to the furthest distance travelled by any one web from its mounting location to the matching location.

The webs on component reels may be formed from paper of the same quality and type or alternatively different webs may have different quality or type such that the collated multi-ply product will have component plies of non-unique paper type.

The live data on each web is typically the same printed data repeated continuously at regular intervals along the web. Where variable data is printed on webs it may be superimposed on the live data after the printing of the live data and typically includes personalised information that requires collation with related personalised information on the web of a second reel.

DETAILED DESCRIPTION OF THE DRAWINGS

Figure 1:
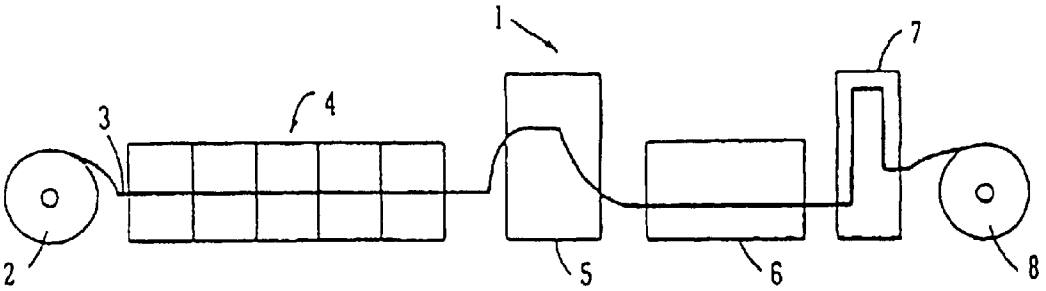
FIG. 1 is a schematic plan view of a production line for printing information on a web of paper in accordance with the invention.

While the present invention is susceptible of embodiment in many forms, there is shown in the drawings and will be hereinafter described one presently preferred embodiment described with reference to the production of a personalised mailer, with the understanding that the present specification is to be considered as an exemplification of the invention, which is not intended to limit the invention to the specific embodiment illustrated.

Figure 4:
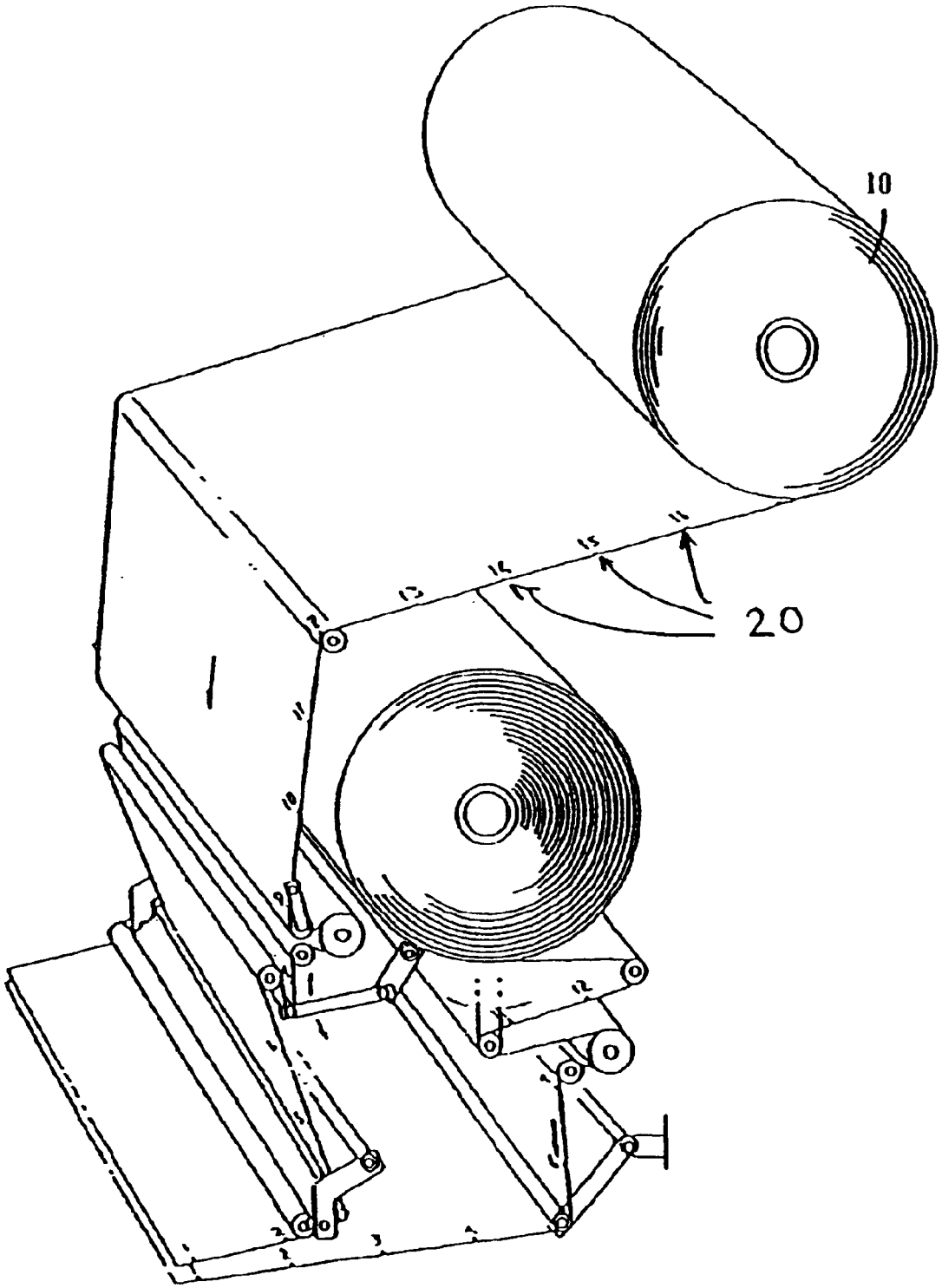
FIG. 4 is a schematic of the path taken by paper from two different reels to the production line, showing the control codes visible on two different webs of paper.

FIG. 1 outlines a printing press 1 utilised in the invention, for the printing of multiple-ply mailers or forms, containing one or more variable data fields. A print run is designed around the size of the database containing the variable data and the known weight or length of a reel of paper 2 that is to be used in the printing press. Using the information about the reel, the number of printed forms that can be obtained from a single reel can be pre-determined, and also whether if it will be necessary to join two or more reels so as to print all the variable data. Based on this pre-calculation the original database of variable data can be separated into two or more print files as required. When generating these print files, control codes (as shown in FIG. 4) are included before and after the variable data. The number of pages, or the length of the web, with the control codes printed thereon is calculated with reference to the furthest distance any one web will have to travel on the collation machine from the unwind station to the alignment point or matching location. This is preferably immediately prior to the sheeting station on the collating machine. Each web of paper that will be used in the preparation of the mailer will have the same number of control codes pre-printed.

For the printing of each print file a fresh reel of paper 2 is brought to an unwind station before a web of paper 3 is then unwound from the reel 2 and fed through printing towers 4. It is printed with non-variable live information or data and passes through an in-line ink jet imaging system 5, such as those manufactured by Scitex. The variable data, pre and anteceded by control codes, is applied and the web is dried using known conventional processes. The web is then fed through a processing bed 6 where die-cutting, line-hole punching, perforation steps etc. are performed. A web inspection video 7 precedes rewind station 8, where the web is rewound into a reel form, and allows for visible inspection of the web as it is being printed. It will be appreciated that the method of the present invention effects the printing of variable data and control codes prior to the assembly of reels at a collator.

Alternatively, the variable data may be printed off-line, in for example a reel to reel variable data system (not shown) using for example ion deposition, lasering etc., although even in this off-line printing system the printing of the variable data is effected prior to the mounting of related reels on the collating machine or collator so as to effect collation of the plies to form a mailer or similar multi-ply printed product.

Figure 2:
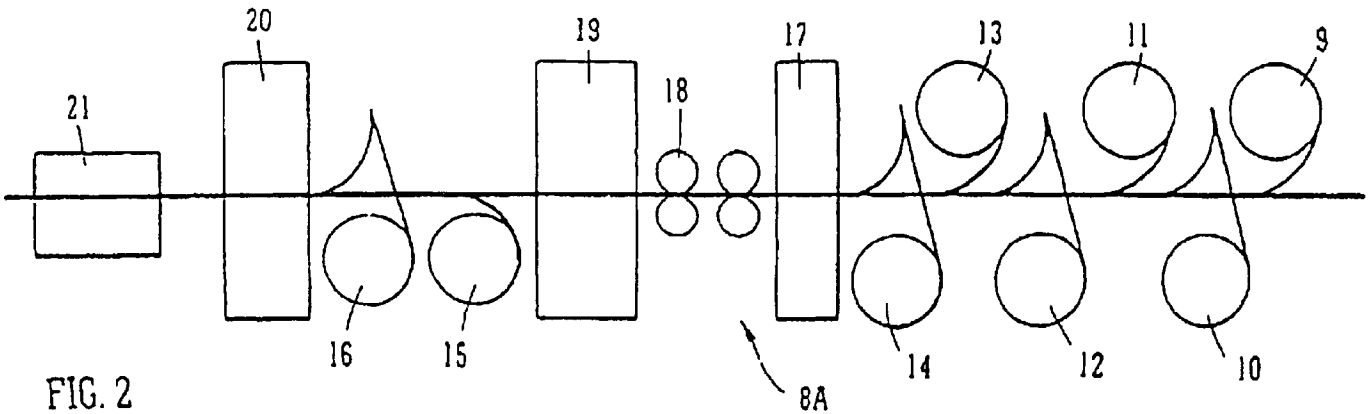
FIG. 2 is a schematic plan view of a production line for use in producing a mailer, by collating webs of related information, in accordance with the invention.

FIG. 2 outlines a collating machine 8*a*, such as that manufactured by Bielolmatik GmBH, designed for the manufacture of a 8 ply mailer, i.e. a mailer with six inserts. As such 8 reels of paper are required; an outer envelope construction (2 reels) and six inserts (6 reels). The reel of paper from the rewind station 8, of the printing press (FIG. 1), is taken to the collating machine, 8*a*. Depending on the design and structure of the finished mailer the reel is positioned at any one of unwind stations 9–14. Stations 15 and 16 are positioned and dedicated to unwind webs of paper forming the back and front plies of the final envelope respectively.

The paper passes from the unwind stations, 9–14, through a pre-cut station 17, where the web is trimmed, a chipping unit 18, and optionally a plough fold 19 which facilitates the folding of plies. After folding, the collated inserts merge with back 15 and front 16 plies of the envelope, one of which has glue applied to form the envelope, before passing to a radio frequency drier 20 and final cutting unit 21. The sides are trimmed to remove any sprocket margins, and cut to form individual envelopes.

Figure 3:
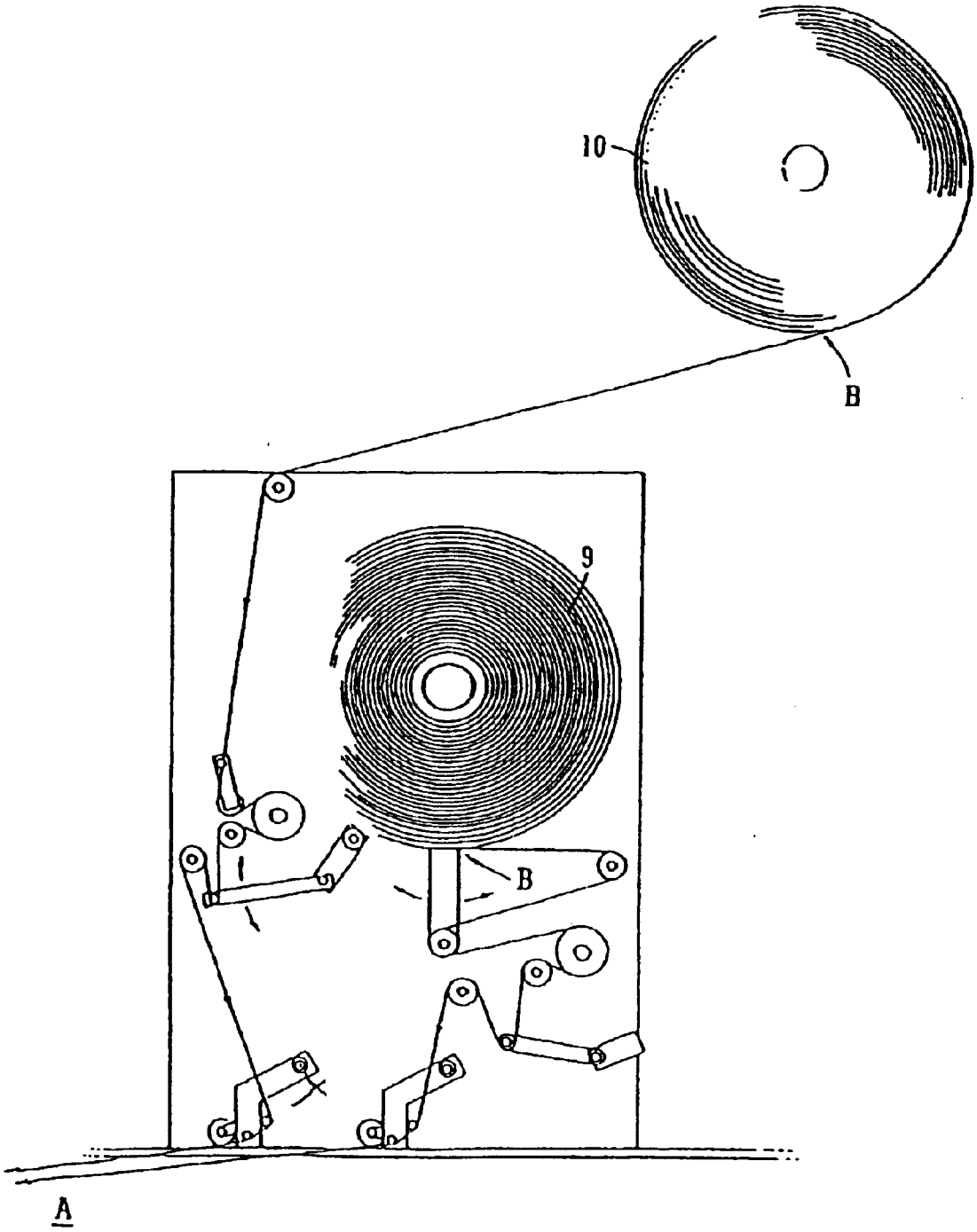
FIG. 3 is a schematic of the path taken by paper from two different reels to the production line.

The distance from the final cutting or sheeting station 21 to each individual reel will always stay the same for each production run, but will be different for individual unwind stations. This location is termed the final alignment location or matching location. Reels can be positioned in any one of a number of unwind stations either above the collating machine or to the side. The position of the reel, as placed in a specific unwind station at the collating machine, will determine the length of paper that is exposed from the reel to the bed of the collating machine. The choice of which unwind station is used for a specific reel is made prior to the printing run, as the unwind stations will finally determine the sorting of the pages in the finished product. For example. the distance paper travels from reel 16 is much less than that for reel 9. This is shown in FIG. 3, which is a schematic of one particular location in the collating machine using the examples of unwind station/reel 9 and unwind station/reel 10, where reel 9 is positioned above the collating machine and reel 10 to the side. As such the distance the web of paper travels from part B on unwind station to the collator bed, (point A), is greater for unwind station 10 than unwind station 9.

For efficient collation of a multi-piece personalised mailer, the variable data information at point A on both plies, must be compatible. From FIG. 3 it is apparent that the distance from A to B, i.e. the distance that the ply of paper travelled from leaving the reel 9 to the bed of the collating machine is much less than that travelled by the paper leaving reel 10 to get to the same position. As such it is very difficult to correctly align each ply at different stages of reel joins.

The use of a control code 20 printed before the variable data on each reel can be used to overcome this problem. The codes 20 at the beginning of a web are called 'lead-in codes'. As the distance from A to b is greater for reel 10 than for reel 9, it is evident that the number of forms/mailers with a control code visible will be much less for reel 9 than for reel 10. Taking the simplified case of FIG. 3 where two reels with compatible information are aligned at position A, this can be achieved by positioning forms with the same lead-in code at the same point, A. This is further clarified in FIG. 4 where the alignment of a multi-ply personalized mailer is achieved by matching the control code of each ply at position 'A', within this example is the numeric symbol 1. As is evident from FIG. 4 control code numeral 16 is the ply visible at unwind station 10 whereas the control code 20 (numeral 13, not shown) would be visible at station 9. As discussed previously, the number of control codes 20 on each reel is calculated for the longest distance A–B that any one ply will have to travel.

The setting up of the production run by matching control codes is called the 'make ready'. Once webs from different reels are aligned using the control code method, the production is commenced and all those mailers with the control code visible are scrapped. The last mailer with the control code visible on the outside indicates to the operator the start of the so-called 'live data'. In cases where there is enough paper on a single reel for the job this is the only time the control codes need to be used. There is a finite number of control codes printed on the web, and this sequence does not continue for the entire length of the web. The control codes are used specifically for the "making-ready" of a collating run, and the finished multi-ply product with live data contained therein—i.e. those products which will be sold—will not have control codes visible.

However, in a lot of cases, the production of a personalised mailer involves the joining of a fresh reel of paper onto an existing reel. When joining fresh reels it is vital that each is joined so that, on final merging of all webs, the correct alignment is achieved. The invention provides for this by printing a control code after, as well as before, live data. The control code at the end of a reel of paper is called the 'lead-out code'. When joining a new reel to a finished reel, the collating is stopped when the first lead-out code on reel 16 is at the final alignment location. Each reel will have its own unique code exposed.

Figure 5:
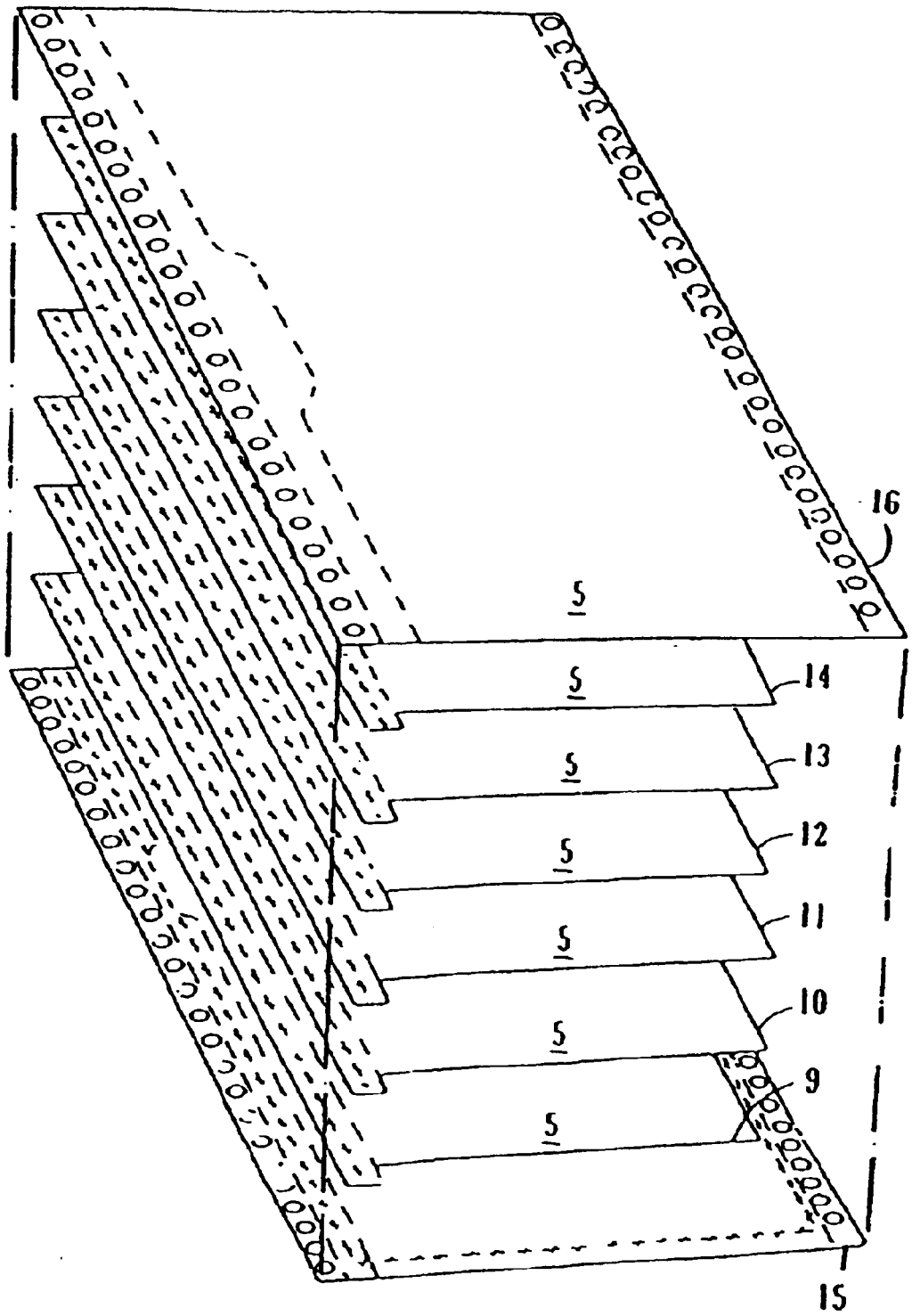
FIG. 5 is an exploded perspective of a formed mailer with multiple sheet insert, with the control code visible, in accordance with one embodiment of the invention.

The finished reel is removed and replaced by a new reel, which will have the same sequence of lead in codes as the lead out codes on the old reel. The new reel is unwound until the lead-in code on the new reel is the same as the lead-out code on the old reel, and all the web is cut at this juncture. These two plies are then superimposed and joined. The process is repeated for each reel, each of which will be joined at the unique code point for that reel. Again, similarly to the initial "make ready", once production is recommenced all mailers with the coded sequence visible, as in FIG. 5, are removed. The merged personalised mailers with live data are now in production. This process is normal collating procedure, apart from the use of control codes to accurately match up related reels. It will be appreciated that the method of the present invention does not incorporate multiple imaging heads at the collator so'as to effect the application of variable data during the collating. The webs are brought to the collator with the variable data printed thereon.

EXAMPLE

The following example outlines a situation where 100,000 personalised mailers with six inserts are required. On analysis of the reels of paper, the maximum number of printed forms on each reel is calculated to be 20,000. As such five reels of paper are required for the complete manufacture of one insert, and forty reels for the entire operation. Each set of five reels corresponds to either an insert to the mailer, or as part of the envelope structure, and as such is allocated a specific position on the collator. Each of these positions are either above or to the side of the collator 8*a*, such that the distance from the reel to the point of alignment varies from reel to reel. It will be appreciated that the distances tabulated are illustrative only and will vary with different applications and/or collating machines.

| Reel number | Distance in feet from reel (point B) to point of alignment (metres) |
|---|---|
| 16 | 20 (6) |
| 15 | 40 (12) |
| 14 | 60 (18) |
| 13 | 50 (15) |
| 12 | 80 (24) |
| 11 | 70 (21) |
| 10 | 100 (30) |
| 9 | 90 (27) |

When joining fresh webs it is vital that each is joined so that on final merging of all webs the correct alignment is achieved. Depending on the page length, e.g. 6"(15.24 cm) 4"(10.16 cm) etc. the control code sequence must be predetermined. Using the example of reel 10 and a numeric sequence for the control code; as 100 feet (30 m) of paper are required, this is equivalent to 100*12"(100*30.48 cm), 200*6"(200*15.24 cm) etc. Therefore each web must have 100 or 200 numbers before and after the live data pages. At the end of each reel run the collator is stopped with the first of the control numbers of reel 16 at the point of final assembly, the final alignment location. Each finished web now has its own unique number exposed on the web end. Reel 16 will have for example numeral 20 exposed, reel 15, 40 and so on until reel 10 with 100. Reel 9 will have 90. It will be appreciated that as the collator is stopped at the point of final assembly that each sequence of numbers for specific reels must be sufficient to run control codes from the unwind station to the final point of assembly.

The fresh webs will also have a numeric sequence at the beginning and each web is exposed until the number on the new web is the as that on the finished web. These two numbered plies are then overlapped and joined. Once production is commenced the mailers with the numbered sequence visible are removed and the merged mailers with the live data are now in production. This process must be employed because at different stages along the distance of the collator different webs will have different joins, and glue points etc.

Although described with reference to the production of personalised mailers which incorporate variable data, it will be appreciated that the method can be applied to the production of any multiple ply product such as but not limited to raffle ticket books, computer manuals printed in variable data applications, the production of books, mail packages and direct mail pieces. The addition of a folding machine at the end of the collating machine will allow this method to be used in the production of personalised books etc. The use of the lead-in and lead out codes facilitates the matching of related webs during collation. There is no need to provide control codes throughout the length of the web. The control codes of the present invention are not used for verification processes during collation, rather only for the making ready of a collating run.

As the imaging of the variable data onto individual plies is effected prior to the collation procedure it is possible, using the method of the present invention, to utilise a single imaging device for imaging data onto multiple reels of paper. The imaging may be effected during the printing of each reel by incorporating the imaging device into the printing system, or alternatively by printing each reel and then running them through a reel to reel imaging system. In all cases the variable data is applied prior to the collation of the reels at the collating machine. As imaging is effected prior to collation the method of the present invention requires a reduced number of imaging heads to that of the prior art systems and the production of personalised products is more cost efficient that that previously employed. It is possible to include a verification system into the collating system to ensure that accurate collation is achieve, although use of the method of the present invention has proven so efficient that this is not required.

What is claimed is:

1. A method for the production and collation of multiple plies to form a multiple ply product, wherein at least two reels of component plies positioned at an unwind station are utilized to form part of the multiple ply product have corresponding variable data printed thereon, comprising the steps of:

a) printing variable data on said component plies, b) printing a sequential control code on the lead in portion preceding the variable data printed on said component plies, c) using the sequence of the control codes to match the component plies having corresponding variable data printed thereon at an alignment location, d) collating all the multiple plies so as to form a multi-ply product, which has corresponding plies of printed variable data, and wherein the printing of the variable data and control codes is effected prior to the reels being positioned at the unwind station.

2. The method as claimed in claim 1, comprising the further step of printing a sequential control code on the lead out portion anteceding the variable data, said lead out control code portion adapted to facilitate the joining of additional reels of component plies so as to form a multiple ply product.

3. The method as claimed in claim 1 comprising the additional set-up step of positioning reels containing each respective ply at pre-determined unwind stations.

4. The method as claimed in claim 3 wherein the control codes are a sequence of pre-determined numbers, the length of the sequence being related to the longest distance travelled by any one ply from the unwind station to the alignment location.

5. The method as claimed in claim 1 where the printing of variable information is effected in an off-line process after the application of the sequential control code to the web.

6. The method as claimed in claim 1 where the printing of variable information is effected in an off-line process after the application of non-variable live information to the web.

7. A collation method for the collating of multiple reels of webs of paper at a collator so as to form multi-ply printed products comprising the steps of:

a) assembling component reels for the production of the printed products at respective mounting locations of the collator, each reel having a web of paper that will form component plies of the finished multi-ply printed products, b) matching, at an alignment location, lead-in control codes printed on the web of a first reel to corresponding control codes printed on the webs of the other component reels, so that individual plies with related live data in the formed multi-ply printed product are overlaying, c) running the collator until all multi-ply printed products with control codes printed thereon are complete, d) discarding the multi-ply printed products with the control codes printed thereon, and e) completing the collating of the related webs so as to form multi-ply printed products with live data, and wherein printing of the control codes on each web is effected prior to the assembly of the reels at the collator.

8. The method as claimed in claim 7 wherein at least two webs of live data have related variable data printed thereon, and the printing of the variable data is also effected prior to the mounting of the reels at the collator.

9. The method as claimed in claim 7, comprising the additional steps of:

a) stopping the collating of the component reels once a web from one of the component reels has lead-out codes exposed, b) joining a second web from a new reel to the existing web of the old reel, the joining being facilitated by the matching of lead-in codes of the second web on the new reel to the lead-out codes of the first reel, c) running the collator so as to complete the collation of webs from related reels, d) discarding the printed products with the control codes visible, and wherein the printing of lead-out control codes after the live data is effected prior to the mounting of the reel on the collator, the joining of the lead-in codes of a new reel to lead-out codes of the old reel effecting the joining of a new reel to an old reel, thereby enabling the production of a number of multi-ply printed products with live data greater than that possible from a single web from each component reel.

10. The method as claimed in claim 7 wherein the discarding of the collated multi-ply products with the control codes printed thereon is effected after the completion of the collating of the products with no control codes thereon.

11. The method as claimed in claim 7 wherein the number of control codes printed on lead-in and lead-out portions of the webs of the component reels is related to the furthest distance traveled by any one web from its mounting location to the alignment location.

12. The method as claimed in claim 7 wherein the webs on component reels are formed from paper of the same quality and type or paper having different quality or type such that the collated multi-ply product will have component plies of non-unique paper type.

* * * * *